US009926855B2

(12) United States Patent
Zhang et al.

(10) Patent No.: US 9,926,855 B2
(45) Date of Patent: Mar. 27, 2018

(54) DEVICE AND METHOD FOR ADJUSTING FUEL SUPPLY ADVANCE ANGLE OF MULTI-CYLINDER DIESEL ENGINE

(71) Applicant: JIANGSU UNIVERSITY OF SCIENCE AND TECHNOLOGY, Jiangsu (CN)

(72) Inventors: Jian Zhang, Jiangsu (CN); Wenxian Tang, Jiangsu (CN); Fei Yan, Jiangsu (CN); Shijie Su, Jiangsu (CN); Qinfeng Li, Jiangsu (CN); Jiyang Qi, Jiangsu (JP); Yongmei Zhu, Jiangsu (CN); Yan Liu, Jiangsu (CN); Kai Yao, Jiangsu (CN)

(73) Assignee: Jiangsu University of Science and Technology, Jiangsu (CN)

( * ) Notice: Subject to any disclaimer, the term of this patent is extended or adjusted under 35 U.S.C. 154(b) by 0 days.

(21) Appl. No.: 15/316,757

(22) PCT Filed: Jun. 1, 2015

(86) PCT No.: PCT/CN2015/080453

§ 371 (c)(1),
(2) Date: Dec. 6, 2016

(87) PCT Pub. No.: WO2016/037498

PCT Pub. Date: Mar. 17, 2016

(65) Prior Publication Data

US 2017/0198645 A1 Jul. 13, 2017

(30) Foreign Application Priority Data

Sep. 10, 2014 (CN) ..... 2014 1 0458682

(51) Int. Cl.
*F02D 1/16* (2006.01)

(52) U.S. Cl.
CPC ..... *F02D 1/16* (2013.01); *F02D 1/162* (2013.01)

(58) Field of Classification Search
CPC ..... F02D 1/16; F02D 1/162
(Continued)

(56) References Cited

U.S. PATENT DOCUMENTS 2,062,084 A * 11/1936 Belyavin ..... F02D 1/162 464/1
2,091,037 A * 8/1937 Harrington ..... F02B 1/12 417/494

(Continued)

FOREIGN PATENT DOCUMENTS

CN 201041119 Y 3/2008
CN 102797606 A 11/2012

(Continued)

OTHER PUBLICATIONS

International Search Report and Written Opinion by State Intellectual Property Office of the P.R. China of PCT/CN2015/080453, dated Sep. 8, 2015.

(Continued)

*Primary Examiner* — Stephen K Cronin
*Assistant Examiner* — Kody Kight
(74) *Attorney, Agent, or Firm* — Edwin S. Flores; Daniel J. Chalker; Chalker Flores, LLP

(57) ABSTRACT

A device and method for adjusting a fuel supply advance angle of a multi-cylinder diesel engine includes a gear chamber, a connecting disc and a fuel pump, wherein the gear chamber and the connecting disc are in the diesel engine, and the fuel pump is at a left end surface outside the gear chamber. A main shaft end of the fuel pump extends into the gear chamber. A right end surface of the connecting disc connects to a timing gear. A right end surface of the (Continued)

timing gear has three penetrating circular-arc waist-shaped holes. Annular sizing blocks are arranged on the waist-shaped holes. A penetrating circular hole is at a tail end of the waist-shaped holes. The circular hole is provided with a T-shaped nut. A support screw is arranged in the T-shaped nut, and the screw head of the support screw is jacked against the annular sizing block.

7 Claims, 4 Drawing Sheets

(58) Field of Classification Search
USPC ..... 123/500, 495
See application file for complete search history.

(56) References Cited

U.S. PATENT DOCUMENTS 3,951,118 A * 4/1976 Henson ..... F02D 1/162 123/501
4,294,218 A * 10/1981 King ..... F02D 1/16 123/501
4,407,155 A * 10/1983 Sundeen ..... F02D 41/009 73/114.28
4,432,326 A * 2/1984 Roca-Nierga ..... F02D 1/183 123/501
4,541,391 A * 9/1985 Gibson ..... F02D 1/16 123/364
4,872,427 A * 10/1989 Gustafson ..... F01L 1/18 123/508
5,533,475 A * 7/1996 Deane ..... F01L 1/02 123/198 C
2007/0227502 A1* 10/2007 Takami ..... F02D 1/162 123/366

FOREIGN PATENT DOCUMENTS

CN 104329174 2/2015
CN 104329174 A 2/2015
WO 2016037498 A1 3/2016

OTHER PUBLICATIONS

Machine Translation of WO2016037498.
Machine Translation of CN20141119Y.
Machine Translation of CN104329174A.
Machine Translation of CN102797606.
English Translation of International Search Report and Written Opinion by State Intellectual Property Office of the P.R. China of PCT/CN2015/080453, dated Sep. 8, 2015.

* cited by examiner

DEVICE AND METHOD FOR ADJUSTING FUEL SUPPLY ADVANCE ANGLE OF MULTI-CYLINDER DIESEL ENGINE

CROSS-REFERENCE TO RELATED APPLICATIONS

This application is the National Stage of International Application No. PCT/CN2015/080453, filed on 1 Jun. 2015 claiming the priority of CN 201410458682.0 filed on 10 Sep. 2014, the content of each of which is incorporated by reference herein.

FIELD OF THE INVENTION

The present invention relates to a device and method for adjusting a fuel supply advance angle of a diesel engine, and more particularly to a device and method for adjusting a fuel supply advance angle of a multi-cylinder diesel engine, which belong to the technical field of marine diesel engines.

DESCRIPTION OF RELATED ART

A fuel supply advance angle of a diesel engine refers to a crank angle from the position of a first cylinder crankshaft of the diesel engine till a piston reaches the top dead center when a first cylinder plunger of a fuel injection pump starts fuel supply. If the fuel supply advance angle is excessively large, because diesel fuel is injected into the cylinder when the air temperature in the cylinder is low, the condition for forming the gas mixture is poor, the ignition delay period is long, the engine works harshly, the combustion is incomplete, and a part of carbon particles are suspended in exhaust gas and are discharged, so black smoke is generated from an exhaust pipe; therefore, the power is reduced and the fuel consumption is increased. If the fuel supply advance angle is excessively small, the combustion process is delayed until the piston reaches the top dead center, the highest temperature and pressure that can be reached are low, the thermal efficiency is significantly reduced, and a part of the diesel fuel that is not combusted becomes a white oil mist to be discharged from the exhaust pipe, that is, white smoke is generated; therefore, the engine is difficult to start, the working pressure is reduced, the thermal loss is increased, the power is reduced, the fuel consumption is increased, and the engine becomes overheated.

In view of the above, whether the fuel supply advance angle of the diesel engine is accurately adjusted not only influences the performances of the diesel engine such as output power and fuel consumption, but also influences the emission of the diesel engine.

Currently, there are mainly two methods for adjusting a fuel supply advance angle of a multi-cylinder diesel engine. One is a disc chuck regulating method: opening an adjusting port cover, unlocking a locking plate, unscrewing two fastening screws out of a splined connecting disc without turning the spline connecting disc, and inserting the fastening screws into another pair of holes to turn the splined connecting disc together with a splined sleeve of a fuel injection pump by an angle. This method belongs to stepped regulation, the adjustment precision is low, the current high requirements on fuel consumption and emission of diesel engines cannot be satisfied, and therefore this method is being phased out in the market.

The other is a pump body rotating method: loosening three fastening screws for connecting a flange of a high-pressure fuel pump to a right end surface of a gear chamber, and rotating a housing of the high-pressure fuel pump to change the position of a plunger of the high-pressure fuel pump relative to an internal cam of the high-pressure fuel pump, thereby changing a fuel supply advance angle. Although this method can theoretically achieve stepless regulation of a fuel supply advance angle, because the pump body of the high-pressure fuel pump is arranged on the right end surface of the gear chamber, this end surface is an end surface of the gear chamber in connection to the engine body, and the pump body is relatively close to the engine body due to structural limitation, it is rather inconvenient to loosen or tighten the fastening screws, and as the fuel supply angle is adjusted by manually rotating the housing of the high-pressure fuel pump, this method has high technical requirements on operators; therefore, in adjusting a fuel supply advance angle of a diesel engine by using the pump body rotating method, the labor intensity is high, the working efficiency is low, and the technical requirements on operators are high.

In the Utility Model Patent Application No. 200720037621.2, entitled "DEVICE FOR MOUNTING AND ADJUSTING FUEL INJECTION PUMP OF ENGINE", the pump body rotating method is used as a method for adjusting an advance angle.

SUMMARY OF THE INVENTION

Technical Problem

An objective of the present invention is to provide a device and method for adjusting a fuel supply advance angle of a multi-cylinder diesel engine which have simple operation and high working efficiency, in order to solve the problems and defects of high technical requirements on operators, low working efficiency and high labor intensity when a pump body rotating method is adopted to adjust a fuel supply advance angle of an existing multi-cylinder diesel engine.

Technical Solution

The objective of the present invention is achieved by the following technical solution.

A device for adjusting a fuel supply advance angle of a multi-cylinder diesel engine includes a gear chamber, a connecting disc and a high-pressure fuel pump, wherein the gear chamber and the connecting disc are assembled in the multi-cylinder diesel engine, and the high-pressure fuel pump is arranged at a left end surface outside the gear chamber. A main shaft end of the high-pressure fuel pump extends into the gear chamber and is fixedly connected to the connecting disc. A right end surface of the connecting disc is fixedly connected to a timing gear of a fuel injection pump. A right end surface of the timing gear of the fuel injection pump is provided with three penetrating circular-arc waist-shaped holes that are away from the center and equally spaced along the circumference direction. Annular sizing blocks are arranged on the waist-shaped holes. Securing screws pass through the annular sizing blocks and the waist-shaped holes to fixedly connect the timing gear of the fuel injection pump to the right end surface of the connecting disc. A penetrating circular hole is arranged at a tail end of at least one waist-shaped hole of the circular-arc waist-shaped holes arranged on the right end surface of the timing gear of the fuel injection pump in a counterclockwise direction and away from the waist-shaped hole. The circular hole is provided with a T-shaped nut, and the axis of the T-shaped nut is in parallel with the end surface of the timing gear of the fuel injection pump. A support screw is arranged in the T-shaped nut, and the screw head of the support screw is jacked against the annular sizing block.

The objective of the present invention can be further achieved by the following technical measures.

The connecting disc has a step-shaped disc structure, and the timing gear of the fuel injection pump is arranged on the step of the connecting disc.

The radian of the waist-shaped holes is not greater than 30°.

A positioning blind hole for supporting the support screw is provided on the outer circumference of the annular sizing block.

A locking nut is provided on the support screw.

A counter bore is provided on a lower end surface of a penetrating circular hole formed on the end surface of the timing gear of the fuel injection pump.

To achieve the above objective, the present invention adopts another technical solution as follows.

A method for adjusting a fuel supply advance angle of a diesel engine includes the following steps:

1. Preparation before adjustment: removing a cylinder head cover and an advancer cover of the diesel engine, disconnecting a high-pressure fuel pipe joint of a first cylinder of the high-pressure fuel pump, and supplying fuel to the high-pressure fuel pump and exhausting gas.

2. Setting of a fuel supply advance angle: rotating a crank pulley, observing that an intake valve and an exhaust valve of the diesel engine are in a closed state, and before a piston is pressed to reach the top dead center, keeping an advance angle index aligned with an advance angle pointer on the crank pulley at an angle specified in the specification of the diesel engine.

3. Adjustment of a fuel supply start point of a first cylinder plunger of the high-pressure fuel pump: loosening the support screw and the securing screws on the timing gear of the fuel injection pump, locking the timing gear of the fuel injection pump by using a crankshaft timing gear, repeatedly swinging the main shaft of the high-pressure fuel pump by using a nut at the top of the main shaft of the high-pressure fuel pump, checking, at a fuel supply port of the high-pressure fuel pump, a fuel outlet start position of the first cylinder plunger when the main shaft of the high-pressure fuel pump rotates in a clockwise direction, and tightening the securing screws of the timing gear of the fuel injection pump after the position is determined.

4. Checking of the fuel supply advance angle: repeatedly rotating the crank pulley before and after the fuel supply advance angle is reached, and checking, at the fuel supply port of the high-pressure fuel pump, the advance angle index corresponding to the advancer pointer on the crank pulley when the crank pulley rotates in a clockwise direction and the first cylinder plunger of the high-pressure fuel pump starts fuel outlet, the corresponding index being the fuel supply advance angle of the diesel engine; when the fuel supply advance angle is different from the angle set in Step 2, readjusting according to Step 3; and when the fuel supply advance angle is the same as the angle set in Step 2, supporting the support screw in the positioning hole of the annular sizing block, and locking the support screw by using the locking nut, thereby locking the fuel supply advance angle of the diesel engine.

5. Resetting: reinstalling and fixing the cylinder head cover and the advancer cover of the diesel engine, and reinstalling the high-pressure fuel pipe joint of the first cylinder of the high-pressure fuel pump onto the fuel supply port, such that the setting of the fuel supply advance angle is completed.

Advantageous Effect

The present invention has the advantages in that: it is convenient to adjust the fuel supply advance angle, and the adjustment precision is high. By redesigning the structure of the timing gear of the fuel injection pump in an existing multi-cylinder diesel engine, the adjustment of the fuel supply advance angle of the diesel engine is implemented by rotating a pump shaft of the high-pressure fuel pump instead of rotating the pump body of the high-pressure fuel pump in the prior art, and the fuel supply start position of the fuel supply port can be directly observed during rotation of the pump shaft, thereby improving the adjustment precision of the fuel supply advance angle; moreover, the operating position changes from the back side of the gear chamber to the front side of the gear chamber, and thus the operation is more convenient. During adjustment of the fuel supply point of the first cylinder plunger of the high-pressure fuel pump, the connecting disc on the main shaft of the high-pressure fuel pump is separated from the timing gear of the fuel injection pump, and the timing gear of the fuel injection pump and the connecting disc on the main shaft of the high-pressure fuel pump are fixed together only after the fuel supply start position of the high-pressure fuel pump is found; therefore, the timing gear of the fuel injection pump may not be installed at a timing position.

Because the timing gear of the fuel injection pump is forced to rotate in a clockwise direction in operation, the present invention adopts a structure in which the support screw unidirectionally supports the securing screws in the rotating direction, such that the relative position between the timing gear of the fuel injection pump and the connecting disc remains constant, and the use requirements of the product are satisfied.

The advantages and features of the present invention are illustrated and explained through non-limiting descriptions of the following preferred embodiments, and these embodiments are only given by way of examples with reference to the accompanying drawings.

Figure 1:
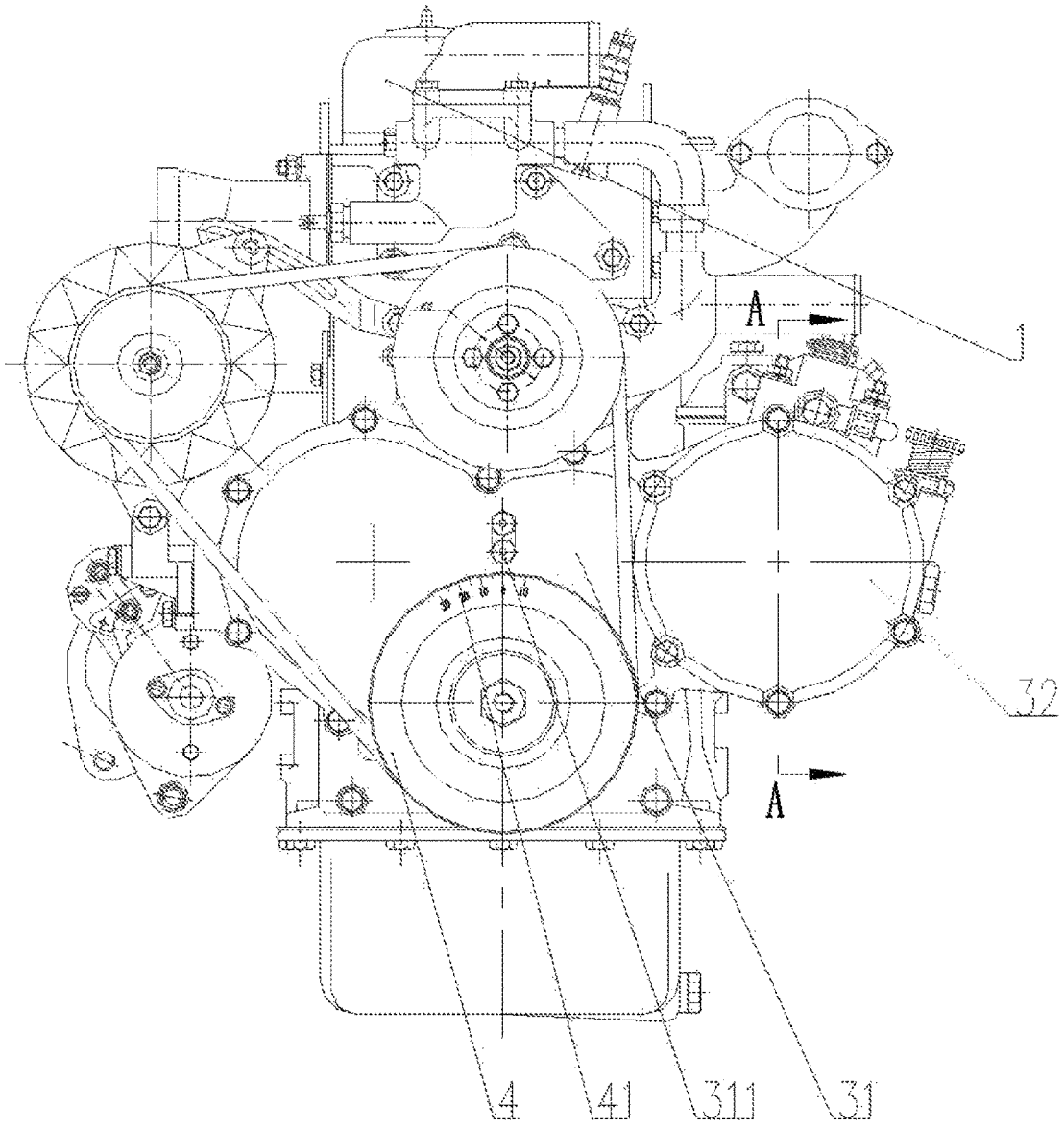
FIG. 1 is a view of an end surface of a gear chamber in a diesel engine according to the present invention.

1: Cylinder cover, 2: High-pressure fuel pump, 21: Pipe joint, 211: Fuel supply port, 22: Main shaft, 23: Key, 24: Nut, 3: Gear chamber, 31: Gear chamber cover, 311: Advance angle pointer, 32: Advancer cover, 4: Crank pulley, 41: Advance angle index, 5: Connecting disc, 6: Fuel injection pump timing gear, 61: Waist-shaped groove, 62: Securing screw, 63: Annular sizing block, 631: Positioning hole, 65: T-shaped nut, 66:

Locking nut, 67: Support screw, 68: Circular hole, 681: Counter bore, 69: Retainer ring, 7: Crankshaft timing gear.

DETAILED DESCRIPTION OF THE INVENTION

The present invention is further described below with reference to the accompanying drawings and embodiments.

In order to make the objectives and technical solutions of the present invention clearer, the technical solutions of the present invention are clearly and completely described below with reference to the accompanying drawings and embodiments.

The terms "inner" and "outer" in the present invention respectively refer to, relative to the device itself, the direction toward the interior of the device and the opposite direction, and are not intended to particularly limit the device and mechanism of the present invention.

The terms "left" and "right" in the present invention respectively refer to, when a reader is facing the drawing, the left side of the reader and the right side of the reader, and are not intended to particularly limit the device and mechanism of the present invention.

The term "connection" in the present invention may refer to direct connection between components or indirection connection between components by means of other components.

The terms "front" and "back" in the present invention refer to, when a reader is facing the drawing, being close to the reader and being away from the reader, and are not intended to particularly limit the device of the present invention.

Figure 2:
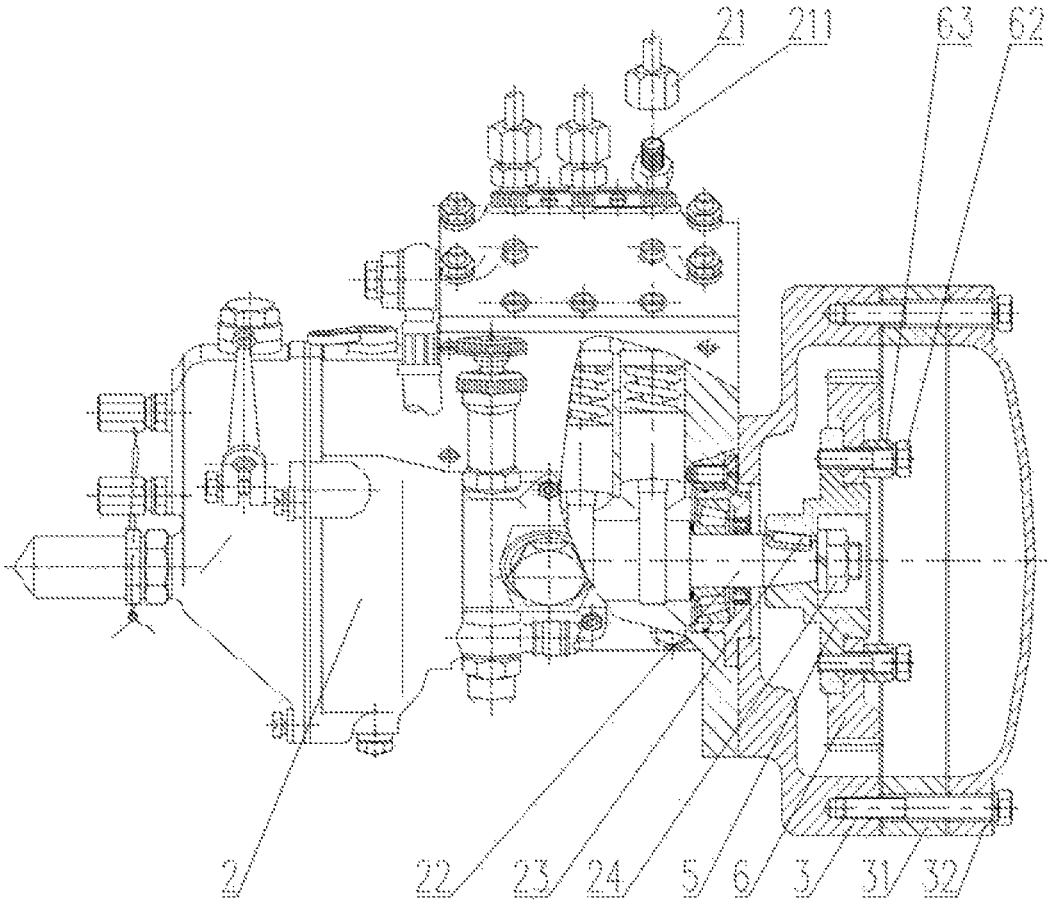
FIG. 2 is a cross-sectional view along A-A in FIG. 1, that is, a schematic view of the construction and assembly of the device according to the present invention.
Figure 3:
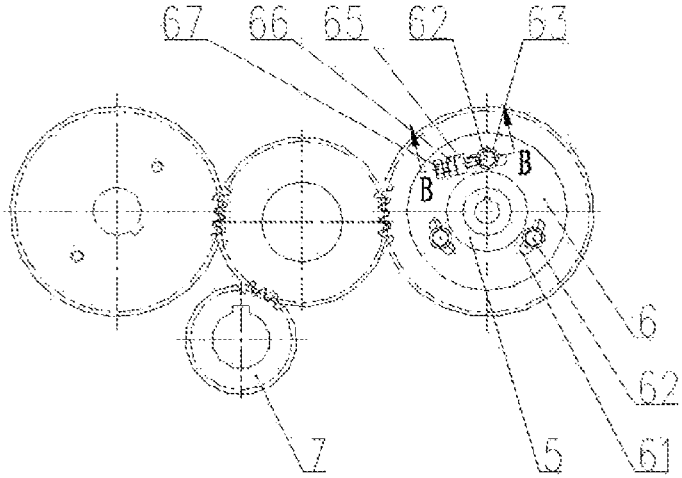
FIG. 3 is a view of a gear train in the gear chamber in FIG. 1.
Figure 4:
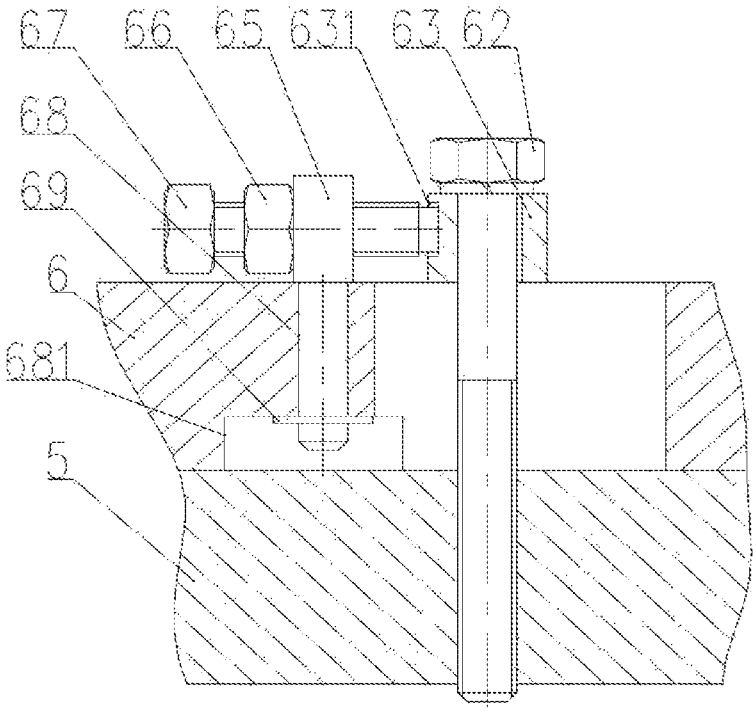
FIG. 4 is a cross-sectional view along B-B in FIG. 3.
Figure 5:
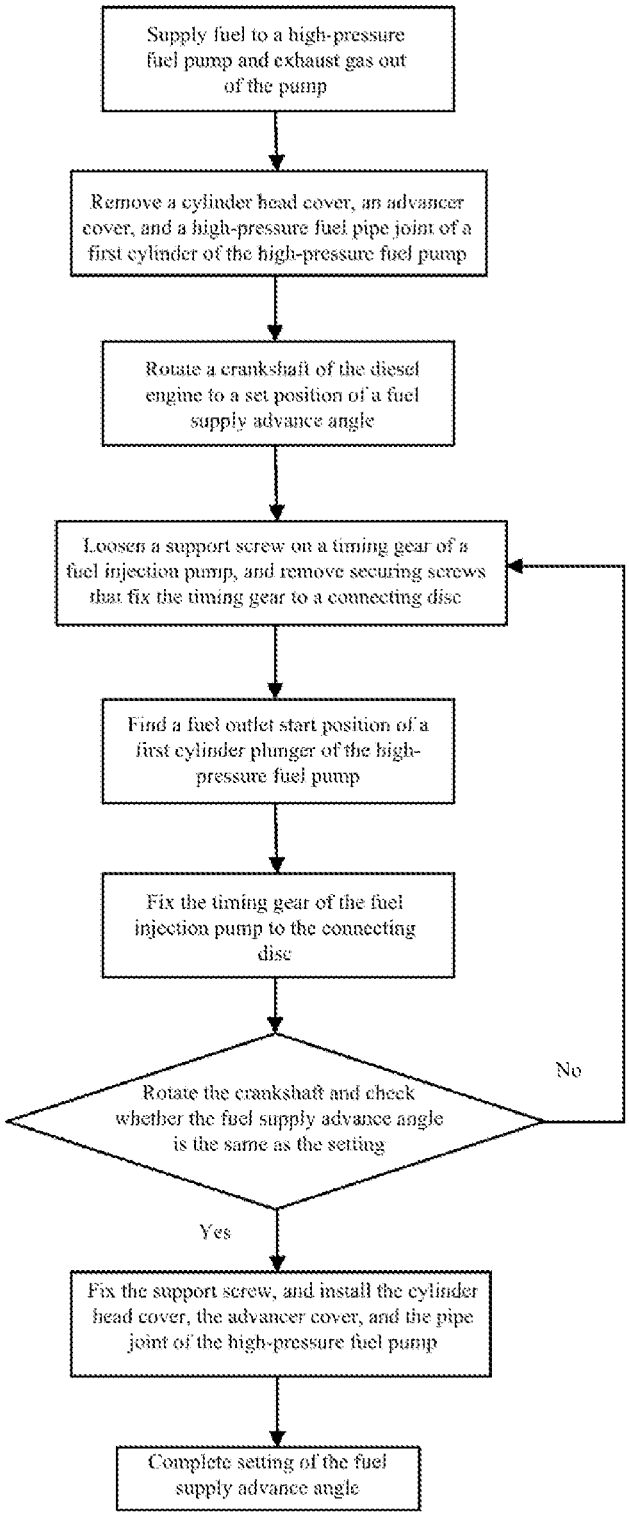
FIG. 5 is a flowchart of a method according to the present invention.

As shown in FIGS. 2, 3 and 4, a device for adjusting a fuel supply advance angle of a multi-cylinder diesel engine includes a gear chamber 3, a timing gear 6 of a fuel injection pump, a connecting disc 5, securing screws 62, and a high-pressure fuel pump 2. The high-pressure fuel pump 2 is fixed on a left end surface outside the gear chamber 3. A main shaft end 22 of the high-pressure fuel pump 2 extends into the gear chamber 3 and is fixedly connected to the connecting disc 5 through a key 23 and a nut 24. An end surface of the timing gear 6 of the fuel injection pump is provided with three penetrating circular-arc waist-shaped holes 61 that are equally spaced along the circumference direction. Annular sizing blocks 63 are arranged on the waist-shaped holes 61. The securing screws 62 pass through the annular sizing blocks 63 and the waist-shaped holes 61 to fix the timing gear 6 of the fuel injection pump on a right end surface of the connecting disc 5. A penetrating circular hole 68 is arranged on an end of one of the waist-shaped holes 61 in a counterclockwise direction on the right end surface of the timing gear 6 of the fuel injection pump. A T-shaped nut 65 is inserted in the circular hole 68, and the axis of the nut hole is in parallel with the end surface of the timing gear 6 of the fuel injection pump. A support screw 67 supported on the annular sizing block 63 is arranged in the T-shaped nut 65.

As shown in FIG. 4, a counter bore 681 is provided at an end of the circular hole 68 in which the T-shaped nut 65 is inserted, the T-shaped nut 65 is connected to the timing gear 6 of the fuel injection pump by using a retainer ring 69 in the counter bore 681, and the T-shaped nut 65 is rotatable about the axis of the circular hole 68. A positioning hole 631 is provided on the outer circumference of the annular sizing block 63, the support screw 67 is supported in the positioning hole 631 of the annular sizing block 63 and is locked by using a locking nut 66, whereby the fuel supply advance angle is locked.

To achieve the above objective, the present invention adopts another technical solution as follows.

As shown in FIG. 1, FIG. 2, FIG. 3, FIG. 4, and FIG. 5, an adjusting method applied by the device for adjusting a fuel supply advance angle of a diesel engine according to the present invention includes the following steps:

1. Preparation before adjustment: removing a cylinder head cover 1 and an advancer cover 32 of the diesel engine, disconnecting a high-pressure fuel pipe joint 21 of a first cylinder of the high-pressure fuel pump 2, and supplying fuel to the high-pressure fuel pump 2 and exhausting gas.

2. Setting of a fuel supply advance angle: rotating a crank pulley 4, observing that an intake valve and an exhaust valve of the diesel engine are in a closed state, and before a piston is pressed to reach the top dead center, aligning 23° indicated by an advance angle index 41 on the crank pulley 4 with an advancer pointer 311.

3. Adjustment of a fuel supply start point of a first cylinder plunger of the high-pressure fuel pump 2: loosening the support screw 67 and the securing screws 62 on the timing gear 6 of the fuel injection pump, locking the timing gear 6 of the fuel injection pump by using a crankshaft timing gear 7, repeatedly swinging the main shaft 22 of the high-pressure fuel pump by using a nut 24 at the top of the main shaft of the high-pressure fuel pump, checking, at a fuel supply port 211 of the high-pressure fuel pump, a fuel outlet start position of the first cylinder plunger when the main shaft 22 of the high-pressure fuel pump rotates in a clockwise direction, and tightening the securing screws 62 of the timing gear 6 of the fuel injection pump after the position is determined.

4. Checking of the fuel supply advance angle: repeatedly rotating the crank pulley 4 before and after the fuel supply advance angle is reached, and checking, at the fuel supply port 211, the advance angle index 41 corresponding to the advancer pointer 311 on the crank pulley 6 when the crank pulley 4 rotates in a clockwise direction and the first cylinder plunger of the high-pressure fuel pump 2 starts fuel outlet, the corresponding index being the fuel supply advance angle of the diesel engine; when the fuel supply advance angle is not 23°, readjusting according to Step 3; and when the fuel supply advance angle is 23°, supporting the support screw 67 in the positioning hole 631 of the annular sizing block 63, and locking the support screw 67 by using the locking nut 66, thereby locking the fuel supply advance angle of the diesel engine.

5. Resetting: reinstalling and fixing the cylinder head cover 1 and the advancer cover 32 of the diesel engine, and reinstalling the high-pressure fuel pipe joint 21 of the first cylinder of the high-pressure fuel pump onto the fuel supply port 211, such that the setting of the fuel supply advance angle is completed.

The present invention may have other implementations in addition to the above embodiments. Any technical solution obtained by equivalent substitution or modification shall fall within the protection scope of the present invention.

What is claimed is:

1. A device for adjusting a fuel supply advance angle of a multi-cylinder diesel engine, comprising a gear chamber, a connecting disc and a high-pressure fuel pump, the gear chamber and the connecting disc being assembled in the multi-cylinder diesel engine, the high-pressure fuel pump being arranged at a left end surface outside the gear chamber, and a main shaft end of the high-pressure fuel pump extending into the gear chamber and being fixedly connected to the connecting disc, wherein a right end surface of the connecting disc is fixedly connected to a timing gear of a fuel injection pump; a right end surface of the timing gear of the fuel injection pump is provided with three penetrating circular-arc waist-shaped holes that are away from the center and equally spaced along the circumference direction; annular sizing blocks are arranged on the waist-shaped holes; securing screws pass through the annular sizing blocks and the waist-shaped holes to fixedly connect the timing gear of the fuel injection pump to the right end surface of the connecting disc; a penetrating circular hole is arranged at a tail end of at least one waist-shaped hole of the circular-arc waist-shaped holes arranged on the right end surface of the timing gear of the fuel injection pump in a counterclockwise direction and away from the waist-shaped hole; the circular hole is provided with a T-shaped nut, and the axis of the T-shaped nut is in parallel with the end surface of the timing gear of the fuel injection pump; and a support screw is arranged in the T-shaped nut, and the screw head of the support screw is jacked against the annular sizing block.

2. The device for adjusting a fuel supply advance angle of a multi-cylinder diesel engine according to claim 1, wherein the connecting disc has a step-shaped disc structure, and the timing gear of the fuel injection pump is arranged on the step of the connecting disc.

3. The device for adjusting a fuel supply advance angle of a multi-cylinder diesel engine according to claim 1, wherein the radian of the waist-shaped holes is not greater than 30°.

4. The device for adjusting a fuel supply advance angle of a multi-cylinder diesel engine according to claim 1, wherein a positioning blind hole for supporting the support screw is provided on the outer circumference of the annular sizing block.

5. The device for adjusting a fuel supply advance angle of a multi-cylinder diesel engine according to claim 1, wherein a locking nut is provided on the support screw.

6. The device for adjusting a fuel supply advance angle of a multi-cylinder diesel engine according to claim 1, wherein a counter bore is provided on a lower end surface of a penetrating circular hole formed on the end surface of the timing gear of the fuel injection pump.

7. An adjusting method applied by the device for adjusting a fuel supply advance angle of a multi-cylinder diesel engine according to claim 1, the method comprising the following steps:

(1) preparation before adjustment: removing a cylinder head cover and an advancer cover of the diesel engine, disconnecting a high-pressure fuel pipe joint of a first cylinder of the high-pressure fuel pump, and supplying fuel to the high-pressure fuel pump and exhausting gas;

(2) setting of a fuel supply advance angle: rotating a crank pulley, observing that an intake valve and an exhaust valve of the diesel engine are in a closed state, and before a piston is pressed to reach the top dead center, keeping an advance angle index aligned with an advance angle pointer on the crank pulley at an angle specified in the specification of the diesel engine;

(3) adjustment of a fuel supply start point of a first cylinder plunger of the high-pressure fuel pump: loosening the support screw and the securing screws on the timing gear of the fuel injection pump, locking the timing gear of the fuel injection pump by using a crankshaft timing gear, repeatedly swinging the main shaft of the high-pressure fuel pump by using a nut at the top of the main shaft of the high-pressure fuel pump, checking, at a fuel supply port of the high-pressure fuel pump, a fuel outlet start position of the first cylinder plunger when the main shaft of the high-pressure fuel pump rotates in a clockwise direction, and tightening the securing screws of the timing gear of the fuel injection pump after the position is determined;

(4) checking of the fuel supply advance angle: repeatedly rotating the crank pulley before and after the fuel supply advance angle is reached, and checking, at the fuel supply port of the high-pressure fuel pump, the advance angle index corresponding to the advancer pointer on the crank pulley when the crank pulley rotates in a clockwise direction and the first cylinder plunger of the high-pressure fuel pump starts fuel outlet, the corresponding index being the fuel supply advance angle of the diesel engine; when the fuel supply advance angle is different from the angle set in Step (2), readjusting according to Step (3); and when the fuel supply advance angle is the same as the angle set in Step (2), supporting the support screw in the positioning hole of the annular sizing block, and locking the support screw by using the locking nut, thereby locking the fuel supply advance angle of the diesel engine; and (5) resetting: reinstalling and fixing the cylinder head cover and the advancer cover of the diesel engine, and reinstalling the high-pressure fuel pipe joint of the first cylinder of the high-pressure fuel pump onto the fuel supply port, such that the setting of the fuel supply advance angle is completed.

* * * * *